US012747405B2

(12) United States Patent
Li et al.

(10) Patent No.: US 12,747,405 B2
(45) Date of Patent: Sep. 29, 2026

(54) METHOD FOR REGULATING AND CONTROLLING GENERATED CRYSTAL FORM OF NATURAL GAS HYDRATE

(71) Applicant: GUANGZHOU INSTITUTE OF ENERGY CONVERSION, CHINESE ACADEMY OF SCIENCES, Guangzhou (CN)

(72) Inventors: Xiaosen Li, Guangzhou (CN); Yisong Yu, Guangzhou (CN); Jianwu Liu, Guangzhou (CN); Wenzhe Sun, Guangzhou (CN); Zhaoyang Chen, Guangzhou (CN)

(73) Assignee: GUANGZHOU INSTITUTE OF ENERGY CONVERSION, CHINESE ACADEMY OF SCIENCES, Guangzhou (CN)

( * ) Notice: Subject to any disclaimer, the term of this patent is extended or adjusted under 35 U.S.C. 154(b) by 0 days.

(21) Appl. No.: 18/705,998

(22) PCT Filed: Nov. 14, 2023

(86) PCT No.: PCT/CN2023/131536
§ 371 (c)(1),
(2) Date: Apr. 30, 2024

(87) PCT Pub. No.: WO2024/032831
PCT Pub. Date: Feb. 15, 2024

(65) Prior Publication Data

US 2025/0122438 A1 Apr. 17, 2025

(30) Foreign Application Priority Data

Oct. 13, 2023 (CN) ..... 202311325588.3

(51) Int. Cl.
*C10L 3/10* (2006.01)

(52) U.S. Cl.
CPC ..... *C10L 3/108* (2013.01); *C10L 2200/029* (2013.01); *C10L 2200/04* (2013.01); *C10L 2270/10* (2013.01)

(58) Field of Classification Search
None
See application file for complete search history.

(56) References Cited

U.S. PATENT DOCUMENTS 10,047,311 B2 * 8/2018 Sangwai ..... B01J 19/008
2013/0178399 A1 * 7/2013 Falana ..... C09K 8/38 507/141
2018/0346791 A1 * 12/2018 Bartels ..... C09K 8/524

FOREIGN PATENT DOCUMENTS

CN 101514300 A 8/2009
CN 101672425 A 3/2010
(Continued)

OTHER PUBLICATIONS

English-language machine translation of CN 104841237 A (Year: 2015).*
(Continued)

*Primary Examiner* — James C Goloboy
(74) *Attorney, Agent, or Firm* — Bayramoglu Law Offices LLC

(57) ABSTRACT

A method for regulating and controlling a generated crystal form of a natural gas hydrate is provided. A mixture composed of a salt substance, a surfactant, a water-soluble thermodynamic additive and water is introduced in a generation process of the natural gas hydrate. The salt substance and the surfactant also have a synergistic effect with a water-soluble thermodynamic accelerator. The addition of the salt substance and the surfactant can change a local solubility of the water-soluble thermodynamic additive in water, so that the regulating and controlling process of the hydrate crystal can be realized, thereby improving a hydrate
(Continued)

gas storage capacity and solving the problem of low natural gas storage capacity in the generated natural gas hydrate in a water-soluble thermodynamic additive system.

5 Claims, 1 Drawing Sheet

(56) References Cited

FOREIGN PATENT DOCUMENTS

| | | | | | |
|---|---|---|---|---|---|
| CN | 104841237 | A | * | 8/2015 | |
| CN | 107903884 | A | * | 4/2018 | ..... F17D 1/16 |
| CN | 111378515 | A | | 7/2020 | |
| CN | 113201373 | A | | 8/2021 | |
| WO | 2012030181 | A2 | | 3/2012 | |
| WO | WO-2015101923 | A1 | * | 7/2015 | ..... C10L 3/108 |

OTHER PUBLICATIONS

English-language machine translation of CN 107903884A (Year: 2018).*

Gambelli, A.M., Rossi, F., "The use of sodium chloride as strategy for improving CO2/CH4 replacement in natural gas hydrates promoted with depressurization methods" Arabian Journal of Geosciences, 2020, 13, 898 (Year: 2020).*

Yi-Song Yu, et al., A kinetic study of methane hydrate formation in the corn Cobs + Tetrahydrofuran solution system, Fuel, 2021, pp. 1-9, vol. 302: 121143.

Do-Youn Kim, et al., Critical Guest Concentration and Complete Tuning Pattern Appearing in the Binary Clathrate Hydrates, Journal of the American Chemical Society, 2006, pp. 15360-15361, vol. 128 No.48.

* cited by examiner

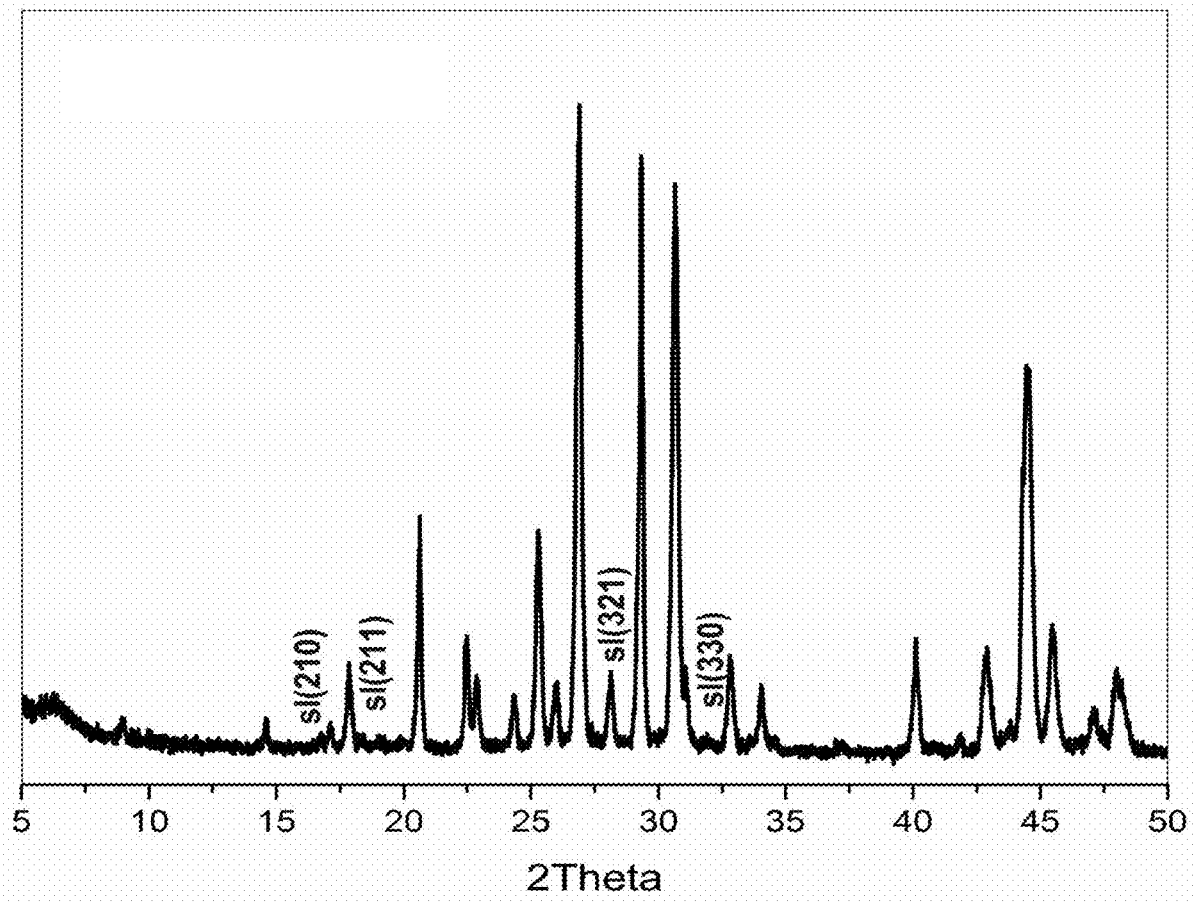
sl(210)
sl(211)
sl(321)
sl(330)
5
10
15
20
25
30
35
40
45
50
2Theta

METHOD FOR REGULATING AND CONTROLLING GENERATED CRYSTAL FORM OF NATURAL GAS HYDRATE

CROSS REFERENCE TO THE RELATED APPLICATIONS

This application is the national Application No. PCT/CN2023/131536, filed on Nov. 14, 2023, which is based upon and claims priority to Chinese Patent Application No. 202311325588.3, filed on Oct. 13, 2023, the entire contents of which are incorporated herein by reference.

TECHNICAL FIELD

The present invention relates to the technical field of gas hydrates, in particular to a method for regulating and controlling a generated crystal form of a natural gas hydrate.

BACKGROUND

Gas hydrates, also known as gas clathrates, are non-stoichiometric crystalline clathrates. In the hydrates, main body water molecules are connected in space by hydrogen bonds, forming a series of polyhedral cavities, which are filled with gas. When crystal lattices are destroyed, for example, by increasing a storage temperature of the gas hydrates, gas will be released. Due to these unique physical and chemical characteristics of the gas hydrates, a gas hydrate technology is widely used in the aspects such as separation, capture, storage or transportation of gas.

The storage and transportation of natural gas has always been a major problem in international natural gas trade and the development of marginal oil and gas fields. At present, the main natural gas transportation modes, such as pipeline-transported natural gas, compressed natural gas and liquefied natural gas, face the shortcomings of high investment and operation cost, long process flow, low safety and the like. As a new natural gas storage and transportation mode, the solidified storage and transportation technology for the natural gas hydrates has the advantages of low cost, high safety and short process flow. In recent years, with the efforts of researchers all over the world, this process has been developed rapidly, but its industrialization process still faces the core problem of lower gas storage capacity of the hydrates. Especially after a thermodynamic additive is adopted to solve the problem of high hydrate generation conditions, the shortcoming of low gas storage capacity of hydrate becomes more and more obvious. This is mainly due to the reason that additive molecules itself participate in the construction of hydrate clathrate space and occupy a part of the hydrate clathrate space, which leaves fewer clathrate space for methane molecules to occupy.

The researchers increased interface contact between liquid water or solid ice and methane gas through various ways to improve a formation rate and a gas storage density of the gas hydrates, including applying high pressure and vigorous stirring, adopting dry water and using a surfactant such as sodium dodecyl sulfate (SDS), and a carrier such as porous silica or polymer.

Although these methods can improve the gas storage capacity of the gas hydrates to a certain extent, they are all realized by forming more natural gas hydrates.

It is urgent to solve the problem of low gas storage capacity of the natural gas hydrates without generating more natural gas hydrates.

The natural gas hydrates are a type of clathrates, with water molecules as a main body, forming a spatial lattice structure, and gas molecules as an object, filling cavities among the lattices, and there is no stoichiometric relationship between gas and water. The water molecules forming the lattices are bonded by stronger hydrogen bonds, while an action force between the gas molecules and the water molecules is van der Waals force. At present, there are four types of found hydrate structures, namely, type I, type II, type H and type T. The type I hydrates have cubic crystal structures, and due to smaller volumes of their inner cavities, the crystal cavities have an average diameter of 0.78 nm and can only accommodate small molecules such as methane, ethane, nitrogen, carbon dioxide and hydrogen sulfide. The I-type hydrates are the most widely distributed in nature, and the hydrates of pure methane and pure ethane are type I. The general composition of this methane hydrate is $CH_4.5.75H_2O$. The II-type hydrates have rhombic crystal structures, and their larger cavities tend to contain hydrocarbon molecules such as propane (C3) and isobutane (i-C4) besides C1 and C2 small molecules. The type H hydrates have hexagonal crystal structures, and their cavities can even contain i-C5 molecules and other molecules with a diameter of 0.75-0.86 nm. By analyzing four types of structural characteristics of the natural gas hydrates, it can be seen that the ratios of small crystal cavities to large crystal cavities of the type I, type II, type H and type T are 1:3, 2:1, 5:1 and 1:4 respectively. If methane occupies all the I-type $5^{12}$ and $5^{12}6^2$, the methane storage capacity of the I-type hydrates is the largest.

Previous studies (1. Yu Y S, Zhang Q Z, $L_v$ Q N, et al. A Kinetic Study of Methane Hydrate Formation in the Corn Cobs+ Tetrahydropyran Solution System[J]. Fuel, 2021, 302: 121143; 2. Kim D Y, Park J, Lee J, et al. Critical Guest Concentration and Complete Tuning Pattern Appearing in the Binary Clathrate Hydrates[J]. Journal of the American Chemical Society, 2006, 128(48): 15360-15361) show that the hydrate formed by the methane gas in a tetrahydrofuran (THF) aqueous solution is only an II-type THF/$CH_4$ mixed hydrate ($16(CH_4)\cdot 8(THF+CH_4)\cdot 136H_2O$).

Therefore, it is urgent to develop a method for regulating and controlling generated crystal forms of a natural gas hydrate, which can generate the I-type hydrates without generating more natural gas hydrates on the basis of reducing generation conditions of the natural gas hydrates in a system added with a water-soluble thermodynamic additive, thereby fundamentally solves the problem of low gas storage capacity of the natural gas hydrates.

SUMMARY

An objective of the present invention is to provide a method for regulating and controlling a generated crystal form of a natural gas hydrate, which solves the problem of low natural gas storage capacity in the generated natural gas hydrate in a water-soluble thermodynamic additive system.

The present invention is realized by the following technical solution:

A method for regulating and controlling a generated crystal form of a natural gas hydrate includes the following steps: introducing a mixture composed of a salt substance, a surfactant, a water-soluble thermodynamic additive and water in a generation process of the natural gas hydrate, and then controlling a temperature at 274.15 K-288.15 K and a pressure at 6-8 MPa.

Particularly, the mixture is subjected to ultrasonic wave dispersion.

The natural gas hydrate is a hydrate formed by gas methane with lower solubility in water.

The water-soluble thermodynamic additive mainly includes the hydrate thermodynamic additives, such as tetrahydrofuran, tetrabutylammonium bromide and tetrabutylammonium fluoride, which are easily soluble in water.

A molar fraction of the water-soluble thermodynamic additive in water is 1.0%-5.6%.

Varieties and concentrations of the salt substance and the surfactant depend on the variety and concentration of the water-soluble thermodynamic additive selected in an experimental process. The ratio of a total mass of the salt substance and the surfactant to a mass of the water-soluble thermodynamic additive is between 1:9 and 1:3, and a ratio of a mass of the surfactant to a mass of the salt substance is between 1:2 and 1:6.

The surfactant includes frequently-used sodium dodecyl sulfate (SDS), sodium dodecyl benzene sulfonate (SDBS), disodium monolauryl sulfosuccinate (DLS) and the like, and it is worth noting that the surfactant is a foaming surfactant, and a high foaming surfactant is more effective. The salt substance includes common sodium chloride (NaCl), potassium chloride (KCl), potassium nitrate (KBr) and the like.

A principle of the present invention is as follows: the regulating and controlling of a methane hydrate crystal mainly includes two steps: first, methane molecules replace additive molecules to occupy large clathrate space ($5^{12}$) of a type II hydrate to form a type II pure methane hydrate; secondly, since the type II pure methane hydrate is unstable, the type II pure methane hydrate can be transformed into a type I methane hydrate quickly by controlling thermodynamic conditions. Wherein, The first step is the key of regulating and controlling the hydrate crystal. For realization of the first step process, according to a classical thermodynamic theory, it can be found this needs to ensure that an occupancy of the methane molecules in the type II hydrate large clathrate space ($5^{12}$) is higher than that of the additive molecules in the large clathrate space ($5^{12}$). This means that the realization of the first step process needs to reduce a solubility of the additive in an aqueous solution. Therefore, how to change the solubility of the water-soluble thermodynamic additive in water has become the key to realize the regulating and controlling of the hydrate crystal in soluble/easily soluble and miscible water-soluble thermodynamic additives. The addition of a mixed reagent of the salt substance and the surfactant can change the local solubility of these thermodynamic additives in water, so that the regulating and controlling process of the hydrate crystal can be realized.

The present invention also protects an application of the above method for regulating and controlling a generated crystal form of a natural gas hydrate to natural gas storage and transportation.

The present invention has the following beneficial effects:

1) The surfactant of the present invention itself can increase a gas-liquid contact area, reduce a gas-liquid mass transfer resistance, and improve the formation rate of the gas hydrate. In addition, the salt substance and the surfactant also have a synergistic effect with a water-soluble thermodynamic accelerator, and the addition of the salt substance and the surfactant can change the local solubility of the water-soluble thermodynamic additive in water, so that the regulating and controlling process of the hydrate crystal can be realized, thereby improving a hydrate gas storage capacity.
2) The materials involved in the technical solution according to the present invention are easily available, the production process and industrial chain are mature and the price is low. There is no need to build a raw material supply ecology.
3) The method for regulating and controlling a generated crystal form of a gas hydrate according to the present invention also provides a gas storage capacity method for a water-soluble natural gas hydrate, which creatively and fundamentally solves the problem of low natural gas storage capacity in the water-soluble thermodynamic additive system.
4) The present invention can be suitable for large-scale generation of the gas hydrate, and can meet industrial development requirements of a natural gas solidified storage and transportation technology based on a hydrate method.

BRIEF DESCRIPTION OF THE DRAWINGS

FIGURE is a PXRD spectrum of a natural gas hydrate obtained in Embodiment 1.

DETAILED DESCRIPTION OF THE EMBODIMENTS

The following further explains the present invention instead of limiting to the present invention.

Embodiment 1

Based on a total mass of 100.00 g, 1.3 g of NaCl, 0.5 g of SDS and 15.00 g of THF were weighed by a balance, and the rest was the mass of water. Firstly, the weighed NaCl, SDS and THF were placed in a closed conical flask and subjected to ultrasonic wave dispersion for 3.5 hours. After completion, the weighed water was added to the dispersed liquid and the ultrasonic wave dispersion was continued for 1.5 hours. After completion, the reaction solution was used for generation reaction of a methane hydrate, and the obtained methane gas storage capacity was 71.43 V/V under the conditions of an initial pressure of 7 MPa and an initial temperature of 274.15 K. At the same time, a pure type I methane hydrate was found in the generated hydrate.

Comparative Example 1

Compared to Embodiment 1, the difference was that NaCl and SDS were not added. As a result, it was found that the generated hydrate was only a type II THE/CH4 mixed hydrate (16(CH4)·8(THF)·136H2O) or 16(CH4)·8(THF+CH4)·136H2O).

Embodiment 2

Based on a total mass of 100.00 g. 2.4 g of NaCl, 0.6 g of SDBS and 17.00 g of THF were weighed with a balance, and the rest was the mass of water. Firstly, the weighed NaCl, SDS and THF were placed in a closed conical flask and subjected to ultrasonic wave dispersion for 5 hours. After completion, the weighed water was added to the dispersed liquid and the ultrasonic wave dispersion was continued for 2 hours. After completion, the reaction solution was used for generation reaction of a methane hydrate, and the obtained methane gas storage capacity was 90.84 V/V under the conditions of an initial pressure of 7 MPa and an initial temperature of 274.15 K. At the same time, a pure type I methane hydrate was found in the generated hydrate.

Embodiment 3

Based on a total mass of 100.00 g. 4.30 g of NaCl, 0.80 g of SDS and 18.00 g of THF were weighed with a balance, and the rest was the mass of water. Firstly, the weighed NaCl, SDS and THF were placed in a closed conical flask and subjected to ultrasonic wave dispersion for 4 hours. After completion, the weighed water was added to the dispersed liquid and the ultrasonic wave dispersion was continued for 1.5 hours. After completion, the reaction solution was used for generation reaction of a methane hydrate, and the obtained methane gas storage capacity was 121.81 V/V under the conditions of an initial pressure of 7 MPa and an initial temperature of 274.15 K. At the same time, a pure type I methane hydrate was found in the generated hydrate, which means that the solution according to the present invention can smoothly realize the regulating and controlling process of the hydrate crystal under the condition that a molar concentration of THF is close to 5.60 mol %.

What is claimed is:

1. A method for regulating and controlling a generated crystal form of a natural gas hydrate, comprising the following steps:

subjecting sodium chloride (NaCl), a surfactant, a water-soluble thermodynamic additive to ultrasonic wave dispersion:

adding water and continuing the ultrasonic wave dispersion to obtain a mixture;

reacting the mixture with natural gas and controlling a temperature at 274.15 K-288.15 K and a pressure at 6 MPa-8 MPa to generate the natural gas hydrate; wherein a ratio of a total mass of the NaCl and the surfactant to a mass of the water-soluble thermodynamic additive is between 1:9 and 1:3, and a ratio of a mass of the surfactant to a mass of the NaCl is between 1:2 and 1:6.

2. The method according to claim 1, wherein the water-soluble thermodynamic additive is selected from one of tetrahydrofuran, tetrabutylammonium bromide, and tetrabutylammonium fluoride.

3. The method according to claim 1, wherein a molar fraction of the water-soluble thermodynamic additive in the water and relative to the water is 1.0%-5.6%.

4. The method according to claim 1, wherein the surfactant is selected from one of sodium dodecyl sulfate, sodium dodecyl benzene sulfonate, and disodium monolauryl sulfosuccinate.

5. A natural gas storage and transportation method comprising:

storing or transporting a natural gas;

regulating and controlling a generated crystal form of a natural gas hydrate according to claim 1.

* * * * *